US005899258A

United States Patent [19]

Bear et al.

[11] Patent Number: 5,899,258

[45] Date of Patent: May 4, 1999

[54] RAM DEVICE

[75] Inventors: Philip N. Bear, Burnsville; Robert J. Krismer, Crystal; Anthony J. Rupar, Maple Grove, all of Minn.

[73] Assignee: Versa Die Cast, Inc., New Hope, Minn.

[21] Appl. No.: 08/843,255

[22] Filed: Apr. 14, 1997

[51] Int. Cl.[6] ..... B22D 17/20; B22D 45/00

[52] U.S. Cl. ..... 164/312; 164/412; 254/133 R

[58] Field of Search ..... 254/133 R; 164/312, 164/412

[56] References Cited

U.S. PATENT DOCUMENTS 4,402,487 9/1983 Donnelly ..... 254/133 R

FOREIGN PATENT DOCUMENTS 5-212529 8/1993 Japan ..... 164/312

1518273 7/1978 United Kingdom ..... 164/312

*Primary Examiner*—J. Reed Batten, Jr.

*Attorney, Agent, or Firm*—Oppenheimer Wolff & Donnelly

[57] ABSTRACT

The ram device forces back components of a die cast machine, having platens that come together to form a product or cast, in order to free products from between the platens. The device has a base and a stem, wherein the stem is longitudinally connected to the base. The base can be releasably attached to a face of a die half wherein the stem is positioned opposite the component to be forced back. The die halves are closed together until a top of the stem engages the component to be moved and the force of the closing die halves is transferred through the ram device to force the component back.

21 Claims, 5 Drawing Sheets

RAM DEVICE

BACKGROUND OF THE INVENTION

The present invention is a device for use when operating press or die casting equipment. More specifically, the present invention relates to a ram used to force back seized injection tips, ejector pins and the like on equipment such as die cast machines.

Die castings are some of the highest volume, mass-produced items manufactured by the metalworking industry. Die casting is a manufacturing method for processing accurately dimensioned, sharply defined, smooth or textured-surface metal parts. Die casting is accomplished by injecting molten metal under high pressure into reusable metal dies. Die casting is a fast, efficient, and economical process which, when used to its maximum potential, replaces assemblies of a variety of parts produced by various manufacturing processes at significant savings in cost and labor. Consequently, because time is critical to the success of a die casting operation, extraneous time spent forcing back stuck components on a die cast machine or removing stuck fragments of a casting from a die cavity is not desirable and can be costly.

Die casting dies are made of alloy tool steels and configured in at least two sections. These two sections are typically referred to as the fixed die half and ejector die half. The fixed die half is mounted on the side of the die cast machine toward a molten metal injection system. Molten metal enters the die through a shot sleeve located in the fixed die half.

The ejector die half is mounted on a movable platen of the die cast machine opposite the fixed die half. The ejector die half usually contains runners (passageways) and gates (inlets) which route the molten metal to the cavity (or cavities) of the die where the part is formed. The ejector die half is also connected to an ejector box which houses a mechanism for ejecting the die casting from the die. The die casting normally adheres to the ejector die half prior to ejection. Ejection occurs when pins, called ejector pins, move forward, to force the die casting from the die cavity.

Ejection typically occurs as part of the opening stroke of the die cast machine. The ejector pins are connected to what is typically referred to as an ejector plate within the ejector box. Connected to the ejector plate, parallel to the ejector pins, are return pins. The return pins return the plate to its casting position as the die closes. Thus, as the ejector plate returns to its casting position, the ejector pins are drawn out of the die cavity.

An injection tip, also known as an injection plunger, is used to force molten metal through the shot sleeve and into the cavity of the die. During the course of metal die casting, an injection tip can become seized in the shot sleeve. Seizure of an injection tip usually occurs when extreme pressure in the sleeve, which can exceed 15,000 psi, forces molten metal back into the space between the interior wall of the shot sleeve and the exterior of the injection tip. When an injection tip becomes seized in a shot sleeve, it becomes necessary to physically force the injection tip back into the sleeve in order to resume the die casting process. In order to physically force the injection tip back, the die cast machine must be stopped and an operator must access the space between the ejector die half and fixed die half.

The conventional way of forcing a seized injection tip back into the shot sleeve is to place a pin between the ejector die half and the head of the injection tip. This pin is usually made from brass or other soft metal in order not to damage the head of the injection tip or other part of the die cast machine. The ejector die half is then closed toward the fixed die half until it contacts the brass pin, wherein the force of the closing ejector die half is transferred through the brass pin to push the injection tip back into place. As the injection tip is pushed back, the solidified metal is forced out of the space between the injection tip and shot sleeve and the die casting cycle can then resume.

There are several problems with the conventional approach of using a brass pin to force the injection tip back. From a safety standpoint, the problems stem from positioning the brass pin in between the two die halves. The pin oftentimes must be held in position during the closure of the ejector die half to be certain that the pin contacts the head of the injection tip properly. Proper positioning avoids damage to the die halves and injection tip. Many machine operators have been injured when an operator has slipped or mispositioned the brass pin or the ejector die half has closed unexpectedly, crushing the hands of the operator in the process. Operators have also been injured when the die halves have closed too quickly while the operator was positioning the brass pin against the head of the injection tip. In addition, damage to the die halves, injection tip or other component can occur when the operator slips or mispositions the brass pin or the ejector die half closes unexpectedly or too quickly.

In addition, the conventional method of using a brass pin can be cumbersome and create costly delay in the die casting process by requiring the operator to slowly close the ejector die half while simultaneously positioning the pin on the head of the injection tip. In addition, the conventional method is costly because two operators are needed to force back the seized injection tip. One operator is needed to hold and position the brass pin while another operator is needed to operate the closing of the die casting machine. All of these slowdowns or delays are extremely costly as they negatively affect efficiency and throughput.

Another situation requiring the conventional method of using a brass pin to drive back a component of a die casting machine arises when an operator needs to force back ejector pins. Sometimes fragments of a cast product remain stuck in the die after the ejector die half pulls away from the fixed die half. When fragments do become stuck in the die, it is not possible to close the ejector die half. To resume the die cast process when this occurs, could damage either of the die halves or other components. In order to remove the fragments or stuck die casting, an operator needs to manually pry the fragment or casting from the fixed die half. This cannot be performed, however, unless the ejector pins protruding from the ejector die half are forced back and out of the way.

One conventional method for returning the ejector pins is to drive the return pins back by placing a brass pin between the return pin and the face of the fixed die half. The return pin is usually fixedly attached at one end to the ejector plate. The same ejector plate also has the ejector pins attached at one end in an array which is parallel to the return pin. To force back the ejector pins, the brass pin is placed between the end of the return pin opposite of the ejector plate and the face of the fixed die cast. The ejector die half is then closed toward the fixed die half until contact is made between the brass pin and both the return pin and the face of the ejector die half. The force of the closing die half is then transferred to the brass pin that, in turn, forces the return pins back, pushing back the ejector pins. Similar safety, economic and efficiency issues arise using the brass pin method in driving back ejector pins as those issues raised in driving back an injection tip. Specifically, damage or harm can occur to the die cast machine or the operator through misplacement of the brass pin or improper closing of the ejector die half. In addition, this process of driving back the return pin requires an operator to spend excess time aligning the brass pin with the return pin and holding the pin until contact is made between the pin, return pin, and fixed die half. Two operators are also required to force back the ejector pins. One operator must hold the brass pin in place while another operator operates the closing of machine.

Another conventional method to force back a seized injection tip or to drive back injector pins is to use a hammer or hammer with pin. The hammer could be brass or just the pin could be brass. This method requires an operator to physically strike the seized injector tip or ejector pins with a hammer or to strike with a hammer a brass pin placed adjacent the seized injection tip or ejector pin.

Striking the injection tip or ejector pins with a hammer is not safe because an operator can be injured by a misplaced blow with the hammer. In addition, a misplaced blow with a hammer can damage the injection tip, ejector pins or other components of the die cast machine.

The hammer method is also time consuming and sometimes not possible. Because of the limited space between the die halves, it is difficult for an operator to gain enough swing force to drive back the seized injection tip or ejector pin. Furthermore, in some situations, it is nearly impossible to even fit a hammer and brass pin or hammer alone between the die halves. Maneuvering a hammer and brass pin, therefore, can be cumbersome and time consuming and many times not feasible.

In summary, the conventional methods of forcing back an injection tip or ejector pins are not desirable. As mentioned, these conventional methods are time consuming, cumbersome, dangerous, potentially harmful to the operator and/or equipment, and sometimes simply not feasible.

SUMMARY OF THE INVENTION

The present invention is a ram device suitable for forcing back components of die cast machines that utilize two platens to form a product or cast. The present invention is a ram device having a base that has a bottom that can releasably attach to a surface such as the face of an ejector or fixed die half. Connected longitudinally to the base is a stem that has a top surface for engaging a seized injection tip or return pin. To force back a seized injection tip or ejector pins, the base of the ram device is releasably attached to the face of a die half opposite the component to be forced back. The operator of the die cast machine then closes the platens of the die cast machine until the top surface of the stem engages the component to be moved back. The force of the closing die cast machine is then transferred through the ram device to the die cast component, forcing the component back.

In one embodiment of the present invention, the stem is fitted with a magnet in the center of the stem base and an attracting magnet is centrally positioned in the top of the base. This allows the stem to be accurately positioned on the top of the base. In addition, by placing a magnet in the stem base, the stem base can be releasably attached to the face of a fixed die half for purposes of forcing back guide pins in those situations where there is not enough clearance between the face of the fixed die half and the guide pin for insertion of both the base and the stem. In addition to the magnets in the stem and the base top, this embodiment also discloses three radially positioned magnets in the base bottom. Wherein the radial placement of the magnets allows the base to be releasably attachable to the ejector die half face where runners and gates might otherwise preclude attachment of a single, centrally positioned magnet.

In a second embodiment, the bottom of the base is fitted with an o-ring shaped magnet that spans along the outer perimeter of the base bottom.

In a third embodiment of the present invention, the stem base is fitted with a centrally positioned magnet and the base top is fitted with a centrally positioned steel insert. Whereby the base comprises a nonferrous material, the steel insert, upon attraction with the stem bottom magnet, positions the stem on the base top.

The present invention is an improvement over the conventional apparatus and methods for forcing back components on die cast machines because of the greater safety of the present invention. The present invention is safer because it allows an operator to releasably attach the ram device to the face of either an ejector die half or a fixed die half, without having to hold the ram device in place while using the force of the closing of the die halves to drive a component back. The present invention is also safer than the conventional method of using a hammer because there is no striking of objects and, thus, no likelihood of a misplaced swing of a hammer. The present invention is also more efficient than the conventional method of using a brass pin because only one operator is needed to force back a component with the present invention as opposed to two operators being needed to force back a component with the conventional method of using a brass pin. In addition, the present invention is a practical improvement over the conventional method of using a hammer because the present invention can be releasably attached to the face of an ejector die half or fixed die half where space is limited and a hammer cannot be utilized.

BRIEF DESCRIPTION OF THE DRAWINGS

The above-mentioned objects and advantages can be more clearly seen by referring to the following detailed description and the drawings in which.

DETAILED DESCRIPTION OF THE INVENTION

Figure 1:
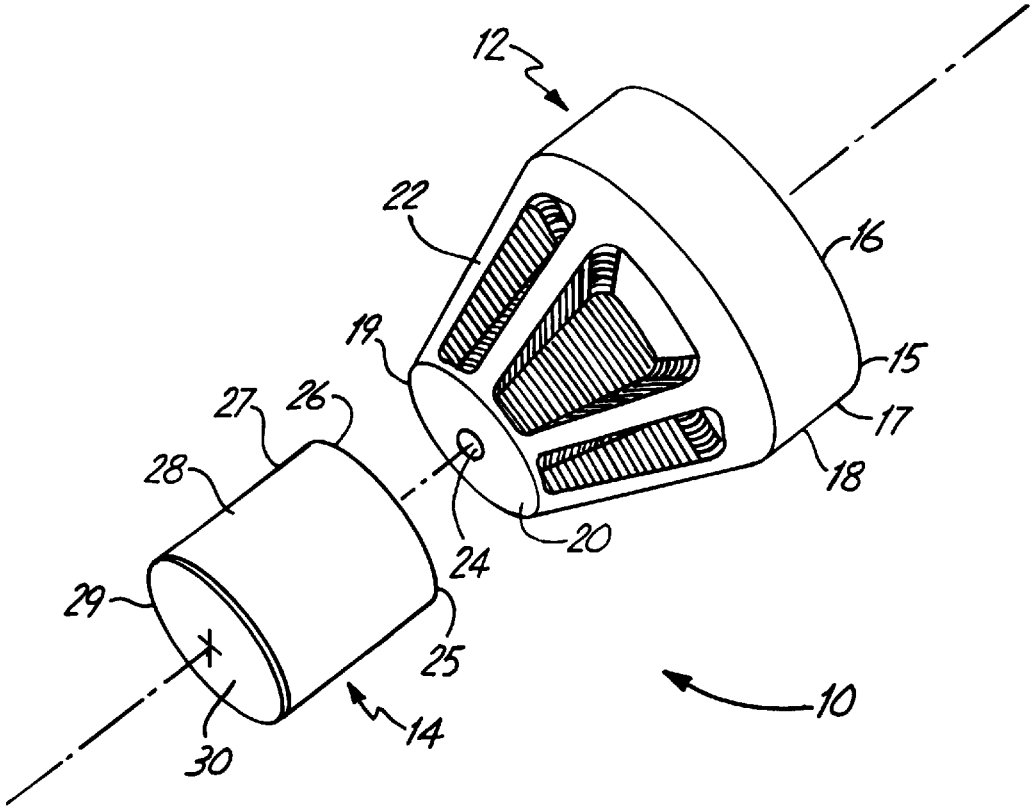
FIG. 1 is a partial exploded view of the present invention.

Referring now to FIG. 1 which shows an exploded view of the present invention. For convenience, like numbers have been used to identify like parts.

FIG. 1 depicts a first embodiment of the present invention shown generally throughout as a ram 10 comprising base 12 and stem 14. The base includes a base bottom 15, base bottom surface 16, base side 17, base side surface 18, base top 19 and base top surface 20. Base 12 further comprises a plurality or tapered reinforcement supports 22 connected longitudinally along base side surface 18. Centrally positioned in base top surface 20 is a base top magnet 24. Base 12 generally has a width great enough to span across any runners or gates in the face of an ejector die half 40 or fixed die half 42. Stem 14 includes a stem bottom 25, stem bottom surface 26, stem side 27, stem side surface 28, stem top 29 and stem top surface 30. In one embodiment, to reduce the possibility of corrosion, base 12 and stem 14 are comprised of a zinc aluminum alloy.

Figure 2:
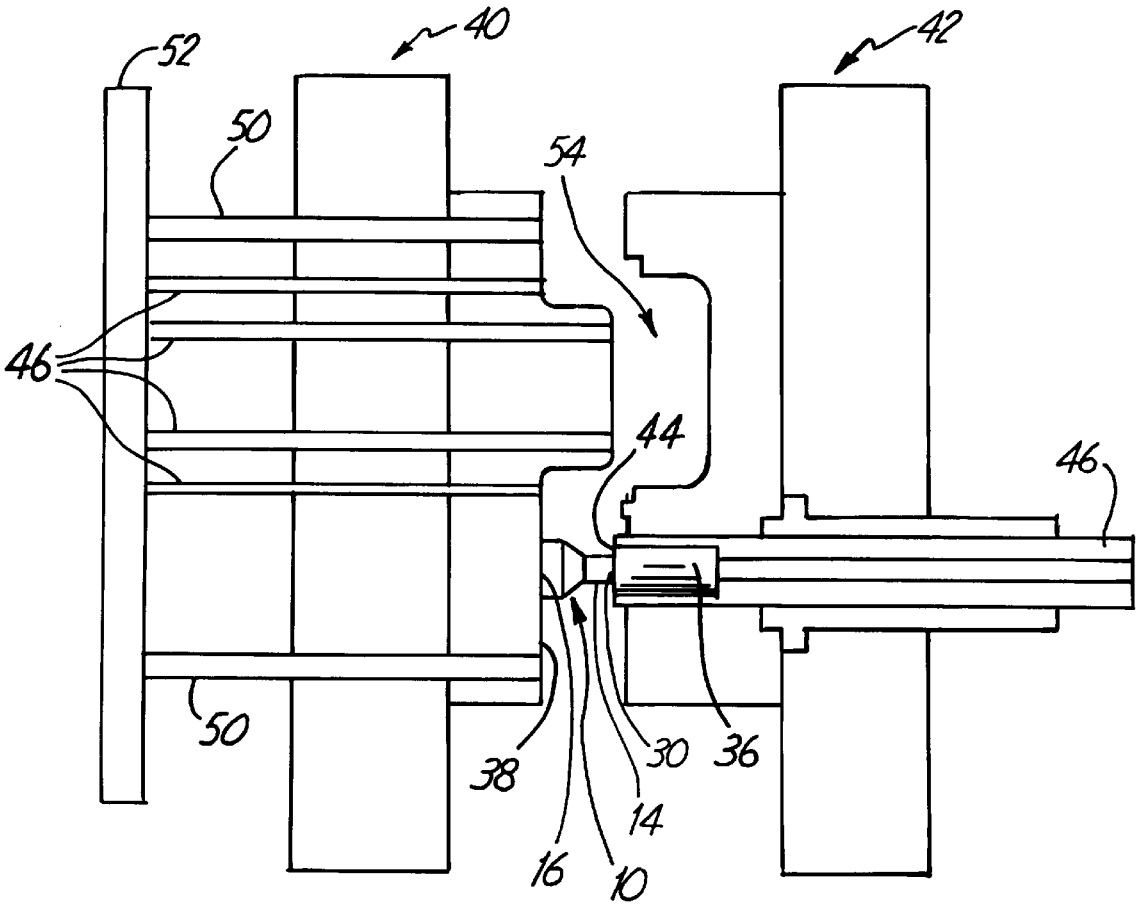
FIG. 2 is a side sectional view of a die cast machine showing the present invention in use.

Referring to FIG. 2 there is shown ram 10 used in operation. More specifically, ram 10 is being used to force back a seized injector tip 36 that is stuck in its forward stroke in a shot sleeve 46. Ram 10 is releasably attached at base bottom surface 16 to an ejector front face 38 of ejector die half 40. In operation, to force back injection tip 36, ejector die half 40 is moved toward fixed die half 42 until stem 14 engages an injection head 44 at the end of seized injection tip 36. Force from closing ejector die half 40 is transferred through ram 10 to seized injection tip 36, through the closing of ejector die half 40 toward fixed die half 42, driving seized injection tip 36 back into shot sleeve 46.

Figure 3:
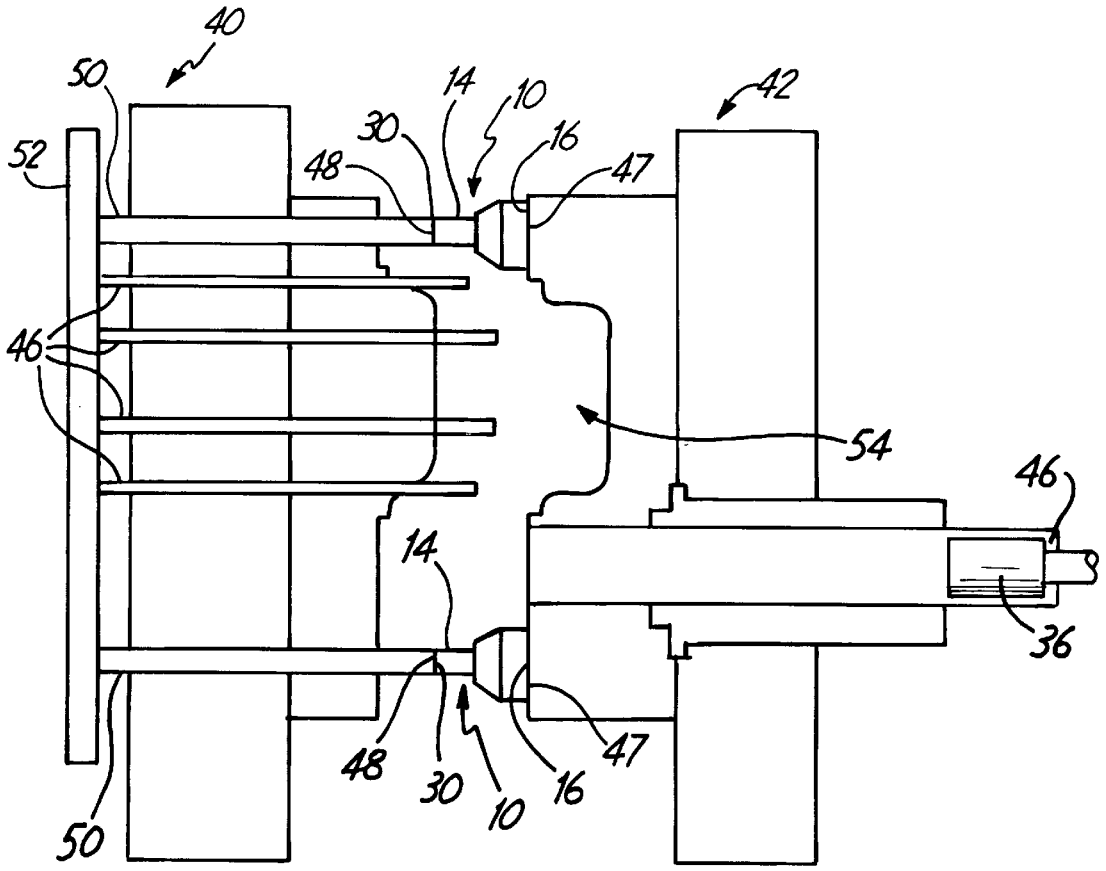
FIG. 3 a side sectional view of a die cast machine having protruding ejector pins showing the present invention in use.

Referring to FIG. 3, there is shown two rams 10 in use. More specifically, each ram is being used to force back ejector pins 46. Ram 10 is releasably attached at base bottom surface 16 to a fixed front face 47 of fixed die half 42. Ejector die half 40 is moved toward fixed die half 42 until stem 14 engages a guide pin top 48 on a guide pin 50. Guide pin 50 is attached at one end to an ejector plate 52. As force from closing ejector die half 40 is transferred through ram 10 to guide pin 50, ejector plate 52 is pushed back. Ejector pins 46 are attached to ejector plate 52 in an array parallel to guide pins 50. As guide pins 50 are pushed back by the closing of ejector die half 40, ejector plate 52 is pushed back, which withdraws ejector pins 46 from a die cavity 54.

Figure 4:
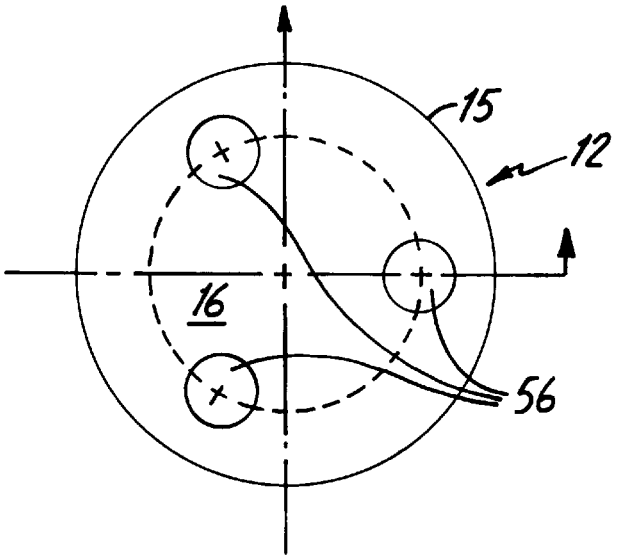
FIG. 4 is a bottom view of a first embodiment of the present invention.

FIG. 4 depicts a bottom view of the first embodiment of base bottom surface 16 comprising three base bottom magnets 56 radially and fixedly positioned in the base bottom 15 of base 12.

Figure 5:
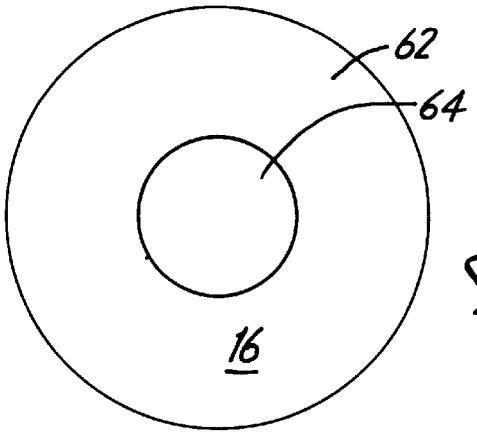
FIG. 5 is a bottom view of a second embodiment of the present invention.

FIG. 5 depicts a bottom view of a second embodiment of base bottom surface 16 comprising a base outer magnet 62 circumferentially attached to a base bottom projection 64.

Figure 6:
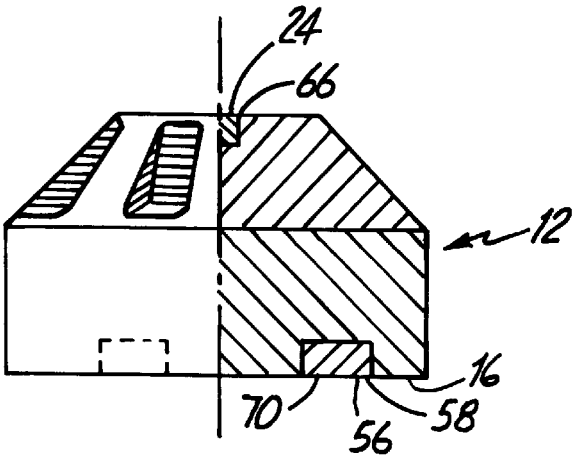
FIG. 6 is a side view, with partial cross section, of the base of the first embodiment of the present invention.

FIG. 6 depicts a side view of the first embodiment, with partial cross section, of base 12 wherein base bottom magnet 56 are each set in a base bottom recess 58 in base 12 with a base bottom magnet bottom surface 70 coplanar with base bottom surface 16. Base top magnet 24 is centrally and fixedly attached to base 12 in a base top central recess 66.

Figure 7:
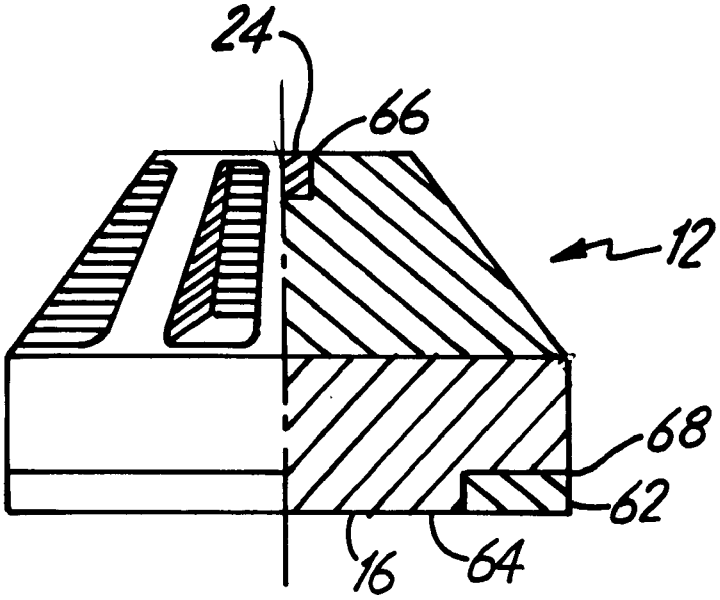
FIG. 7 is a side view, with partial cross section, of the base of the second embodiment of the present invention.

FIG. 7 depicts a side view of the second embodiment, with partial cross section, of base 12 comprising base outer magnet 62 circumferentially attached to base bottom projection 64 within an annular recess 68. Base top magnet 24 is centrally and fixedly attached to base 12 in base top central recess 66.

Figure 8:
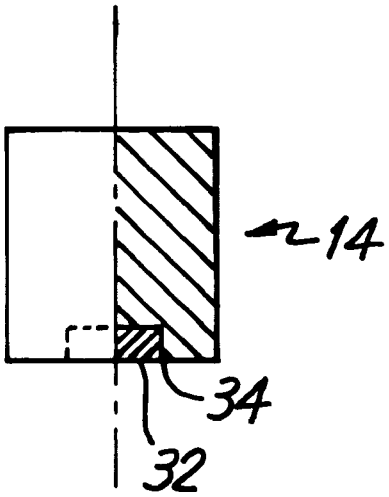
FIG. 8 is a side view, with partial cross section, of the stem of the first embodiment of the present invention.

FIG. 8 depicts a side view of stem 14 comprising a stem bottom magnet 32 set in a stem bottom recess 34. In those cases where base 12 and stem 14 are comprised of a non-magnetic material such as zinc aluminum, a steel insert can be used in place of base top magnet 24 to create a magnetic connection between base 12 and stem 14.

Having illustrated and described the principles of the present invention in the preferred embodiments it will be apparent to those skilled in the art that the invention can be modified in arrangement and detail without departing from such principles. We claim all modifications coming within the scope and spirit of the following claims.

It is clamed:

1. A ram device for forcing back components on equipment, the ram device comprising:

a base having at least one side and a base bottom, the base bottom having a means to releasably attach to a surface; and a stem having at least one side and a stem top, the stem being attached to the base such that the stem top and base bottom are positioned at opposite ends of the ram device.

2. The ram device of claim 1, wherein the stem has a stem bottom, a stem top, and at least one stem side, and the base has a base bottom, a base top, and at least one base side, the stem releasably attachable to the base such that the base top is in juxtaposition with the stem bottom.

3. The ram device of claim 1, wherein the base has a transverse width greater than the transverse width of the stem.

4. The ram device of claim 2, wherein the base has a transverse width greater than the transverse width of the stem.

5. The ram device of claim 4, wherein the base is magnetized.

6. The ram device of claim 4, wherein the stem is magnetized.

7. The ram device of claim 6, wherein the base is magnetized.

8. The ram device of claim 1, wherein the base side has at least one tapered reinforcement support positioned thereon.

9. A ram device for forcing back components on equipment having moving platens, the ram device comprising:

a cylindrical-shaped base having a base bottom surface, a base top surface and a base side surface, the base bottom surface having a means to releasably attach to a surface;

a cylindrical-shaped stem having a stem bottom surface, a stem top surface and a stem side surface, the stem having a radius less than the radius of the base; and the stem bottom surface attached to the base top surface.

10. The ram device of claim 9 wherein the stem bottom surface is releasably attachable to the base top surface.

11. The ram device of claim 9, further comprising a magnet positioned in the base bottom surface.

12. The ram device of claim 10, further comprising a magnet positioned in the base bottom surface.

13. The ram device of claim 10, further comprising a stem bottom magnet positioned in the stem bottom surface.

14. The ram device of claim 13, further comprising a steel insert positioned in the base top surface.

15. The ram device of claim 12, further comprising a base top magnet positioned in the base top surface.

16. The ram device of claim 13, further comprising at least one base magnet radially positioned in the base bottom surface.

17. The ram device of claim 16, wherein the stem bottom magnet is centrally positioned in the stem bottom surface.

18. The ram device of claim 17, further comprising a steel insert centrally positioned in the base top surface.

19. The ram device of claim 18, further comprising at least one tapered reinforcement support positioned on the base side surface.

20. The ram device of claim 19, wherein the stem and the base comprise a zinc aluminum alloy.

21. A ram device for forcing back components on a die cast machine, the ram device comprising:

a base of generally cylindrical shape having a base bottom, a base side and a base top, the base top having a centrally positioned base top recess formed therein, and the base side having at least one circumferentially positioned tapered reinforcement supports;

a plurality of base bottom magnets, the base bottom magnet radially set in the base bottom;

a steel insert centrally positioned in the base top;

a stem of generally cylindrical shape having a stem bottom, a stem side and a stem top, the stem bottom having a stem bottom recess centrally formed in the stem bottom;

a stem bottom magnet, the stem bottom magnet fixedly set in the stem bottom recess, and releasably attachable to the steel insert.

* * * * *